US008798293B2

(12) United States Patent
Liu et al.

(10) Patent No.: US 8,798,293 B2
(45) Date of Patent: Aug. 5, 2014

(54) PIEZOELECTRIC SPEAKER

(75) Inventors: Lin Liu, Shenzhen (CN); Jie He, Shenzhen (CN); Sheng-Ping Yu, Shenzhen (CN)

(73) Assignees: AAC Acoustic Technologies (Shenzhen) Co., Ltd., Shenzhen (CN); American Audio Components Inc., La Verne, CA (US)

( * ) Notice: Subject to any disclaimer, the term of this patent is extended or adjusted under 35 U.S.C. 154(b) by 401 days.

(21) Appl. No.: 13/332,334

(22) Filed: Dec. 20, 2011

(65) Prior Publication Data

US 2012/0155678 A1 Jun. 21, 2012

(30) Foreign Application Priority Data

Dec. 21, 2010 (CN) ..... 2010 1 0598520

(51) Int. Cl.
*H04R 25/00* (2006.01)

(52) U.S. Cl.
USPC ..... 381/190; 381/191; 381/114; 381/173; 310/322; 310/324; 310/328; 310/330; 310/334

(58) Field of Classification Search
CPC ..... H04R 1/00; H04R 17/00; H04R 17/06; H01L 41/083; H01L 41/08; H01L 41/053
USPC ..... 381/190, 191, 114, 173; 310/324, 327, 310/328, 334, 330
See application file for complete search history.

(56) References Cited

U.S. PATENT DOCUMENTS

| | | | | |
|---|---|---|---|---|
| 7,242,786 | B2 * | 7/2007 | Åsnes | 381/326 |
| 8,363,870 | B2 * | 1/2013 | Åsnes | 381/326 |
| 2009/0060234 | A1 * | 3/2009 | Liou et al. | 381/191 |

* cited by examiner

*Primary Examiner* — Davetta W Goins
*Assistant Examiner* — Jasmine Pritchard
(74) *Attorney, Agent, or Firm* — Anova Law Group, PLLC

(57) ABSTRACT

A piezoelectric speaker includes a cover with a receiving space and a vibrating speaker unit accommodated in the receiving space. The vibrating speaker unit includes a piezoelectric oscillator including an upper surface and an lower surface, a diaphragm disposed on the upper surface of the piezoelectric oscillator, and a vibrating member kept a distance from the lower surface of the piezoelectric oscillator. The piezoelectric oscillator defines a first amplitude capable of driving the diaphragm only and a second amplitude driving both the vibrating member to vibrating with a largest amplitude and the diaphragm to generate sound. The distance is larger than the first amplitude and smaller than the second amplitude.

20 Claims, 3 Drawing Sheets

PIEZOELECTRIC SPEAKER

FIELD OF THE INVENTION

The present disclosure relates to a speaker, and more particularly to a piezoelectric speaker having a piezoelectric oscillator.

DESCRIPTION OF RELATED ART

In mobile telecommunication terminals such as handsets, there are two ways of calls reminder, voice reminder and vibration reminder. The voice reminder is performed by a speaker, and the vibration reminder is performed by a vibration motor in existing technology. With the rapid development of the telecommunication technology, users want more functions and smaller volumes in accordance with the terminals, which leads to the number of the electrical components and accessory parts within handsets is decreased and the volume thereof becomes smaller.

Therefore, it is necessary to provide a new speaker with simplified structure, in which multi-functions like voice reminder and vibration reminder are provided.

DETAILED DESCRIPTION OF THE EMBODIMENT

Reference will now be made to describe the exemplary embodiment of the present disclosure in detail.

Figure 1:
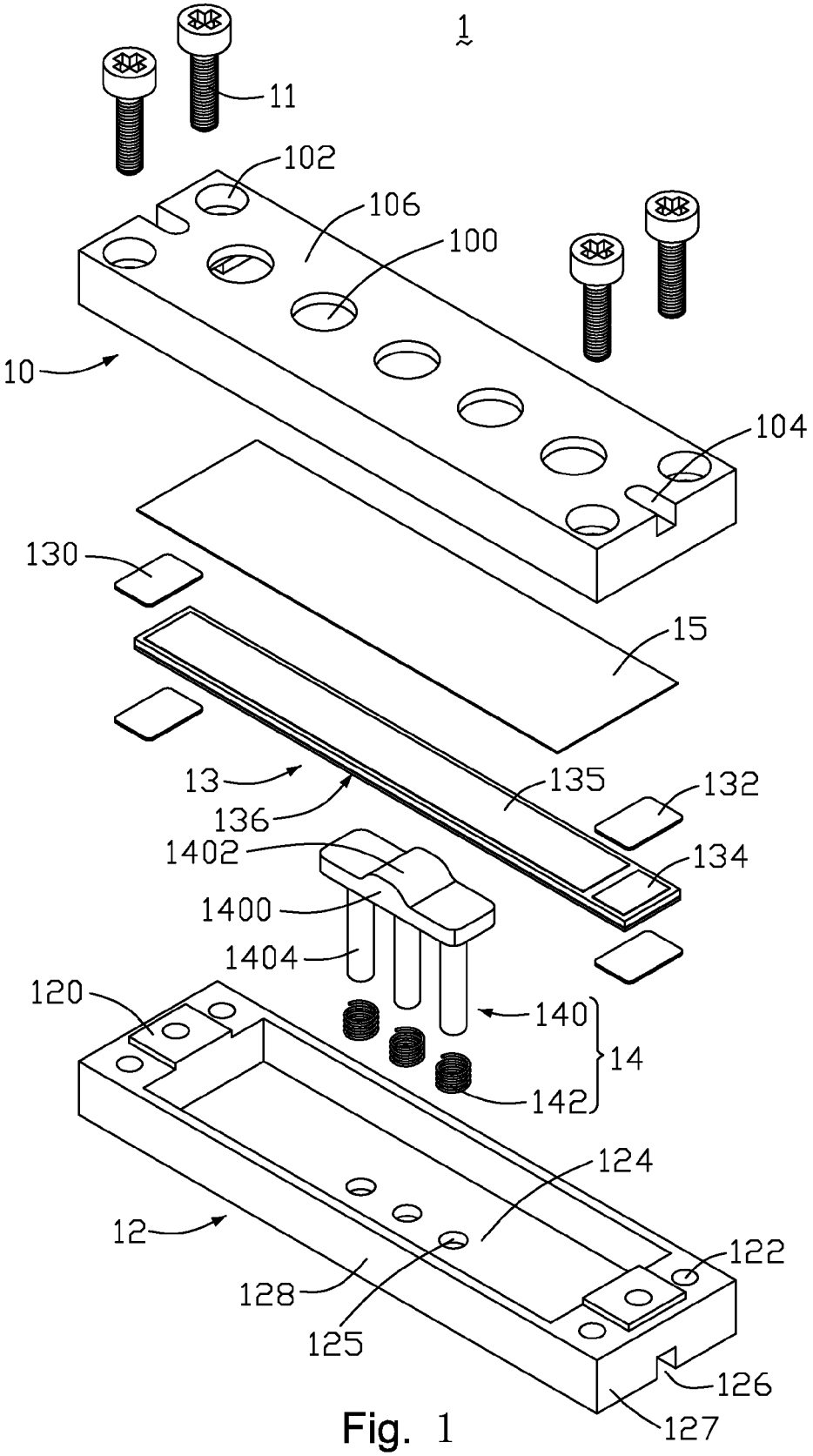
FIG. 1 is an isometric exploded view of a piezoelectric speaker in accordance with an exemplary embodiment of the present disclosure.
Figure 2:
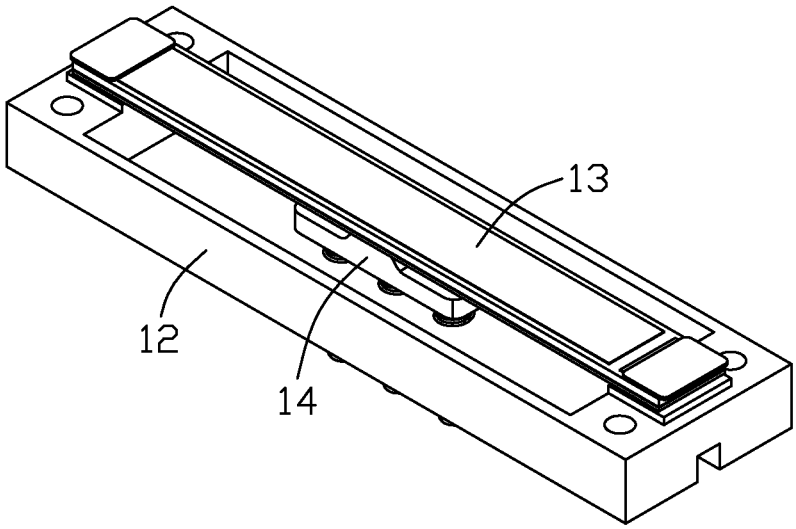
FIG. 2 is an assembled view of a piezoelectric oscillator engaged with a vibrating member and a lower cover of the piezoelectric speaker.
Figure 3:
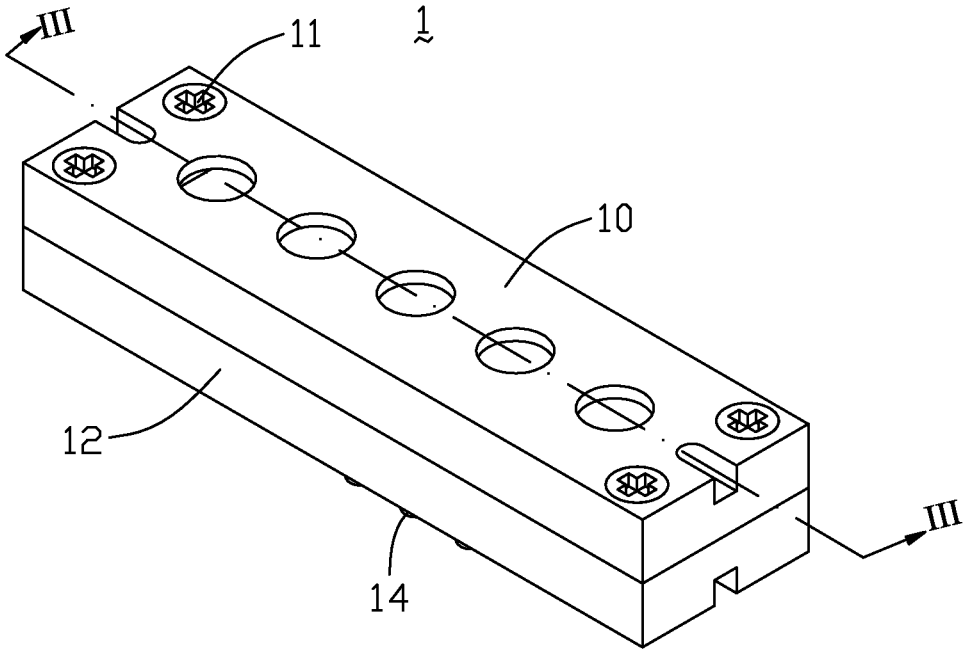
FIG. 3 is an assembled view of the piezoelectric speaker in FIG. 1.
Figure 4:
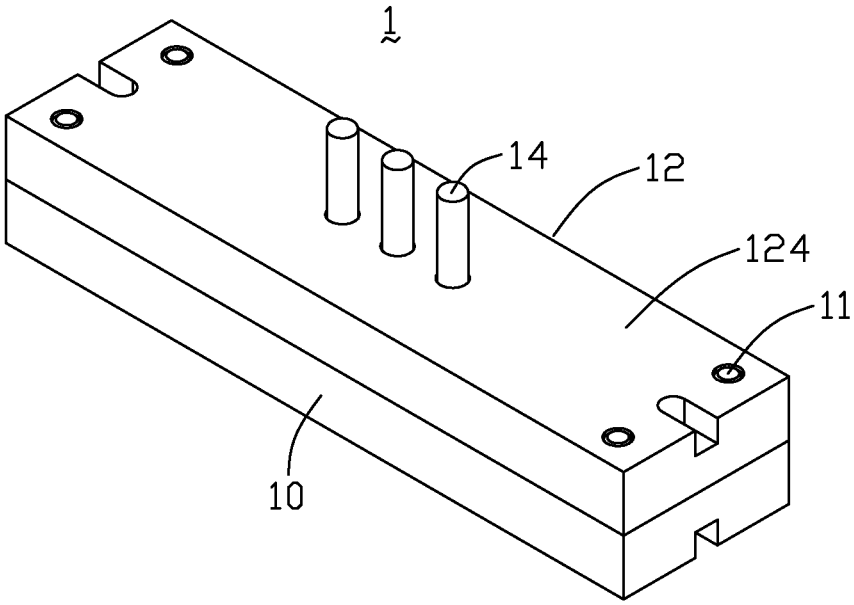
FIG. 4 is an assembled view from another perspective of FIG. 3.
Figure 5:
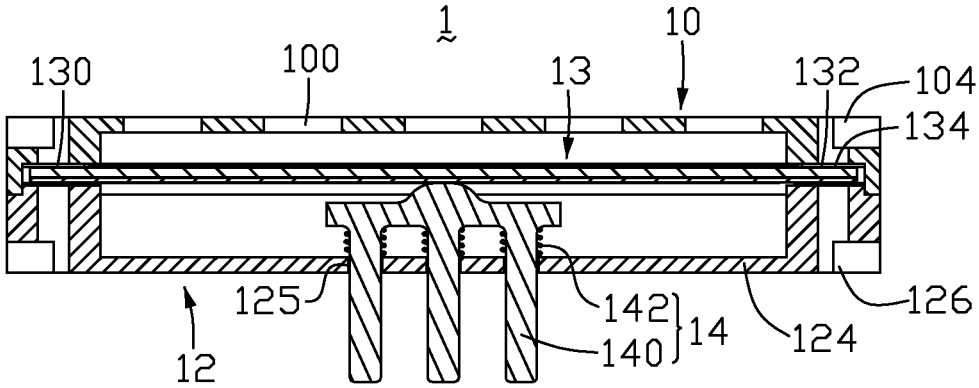
FIG. 5 is a cross-sectional view of the piezoelectric speaker taken along line III-III in FIG. 3.

Referring to FIGS. 1-5, a piezoelectric speaker 1 includes a cover, a number of bolts 11, a piezoelectric oscillator 13, a vibrating member 14, and a diaphragm 15. The cover includes an upper cover 10 and a lower cover 12.

The upper cover 10 includes an upper wall 106 and a number of sidewalls together forming a first cavity. The upper wall 106 is rectangular and defines a pair of long sides and a pair of short sides. The upper wall 106 further defines a number of sound holes 100 ranged in a line parallel to the long side of the upper wall 106, four first bolt holes 102 passing through four corners of the upper wall 106, and two first conductive slots 104 disposed at a mid portion of short sides and ranged in a line with the sound holes 100. Each first conductive slot 104 defines a circular aperture and a rectangular aperture communicating with the circular aperture. The bolt holes 102 are used for receiving the bolts 11. In fact, the number of the sound holes 100 may be varied according to specific requirements.

The lower cover 12 includes a bottom wall 124 and a number of sidewalls together forming a second cavity. The sidewalls of the lower cover 12 include a pair of first sidewalls 127 extending along a transverse direction and a pair of second sidewalls 128 extending along a longitudinal direction with a smaller thickness than that of the first sidewall 127. Each first sidewall 127 defines a position block 120 protruding upwards from an upper face thereof, two second bolt holes 122 disposed at two sides of the position block 120, and a second conductive hole 126 passing through the position block 120. The bottom wall 124 is rectangular and defines a same surface area as the upper wall 106 of the upper cover 12. The position block 120 is made from elastic or plastic material, which is rectangular and defines a smaller width than the thickness of the first sidewall 127 and a smaller length than that of the second cavity along the transverse direction. The second bolt holes 122 are aligned with the first bolt holes 102 and used for receiving the bolts 11. The bottom wall 124 defines three through holes 125 ranged in a line parallel to the sound holes 100. The second conductive hole 126 is disposed at a mid portion of the first sidewall 127 and defines a circular hole and a rectangular hole communicating with the circular hole 1261.

The piezoelectric oscillator 13 includes a number of overlapping piezoelectric plates made from piezoelectric material capable of generating converse piezoelectric effect while being placed in an electric field, such as piezoelectric crystal, piezoelectric ceramic or organic polymers material, and so on. The converse piezoelectric effect leads to a mechanical distortion of the piezoelectric plates. In present embodiment, the piezoelectric oscillator 13 has a configuration of a rectangular parallelepiped and defines an upper surface 135 and an opposite bottom surface 136. The piezoelectric oscillator 13 is supported by the position blocks 120 of the lower cover 12. The piezoelectric oscillator 13 includes two negative pole plates 130 disposed at two surfaces of one end thereof, two positive pole plates 132 disposed at two surfaces of the other end thereof, and a metallic plate 134 disposed between the two positive pole plates 132 and electrically connecting with the two positive pole plates 132. The negative pole plates 130, the positive pole plates 132, the metallic plate 134 and the position block 120 have similar appearance and same size.

When a high-frequency electrical signal is supplied to the piezoelectric plates, a corresponding vibration of the piezoelectric plates with a first amplitude is generated by the converse piezoelectric effect, which could drive the diaphragm to push ambient air to generate sound but couldn't drive the vibrating member 14 to vibrate. When a low-frequency electric signal is supplied to the piezoelectric plates, a corresponding vibration of the piezoelectric plates with a second amplitude is generated, which could drive the vibrating member 14 to vibrate with a largest amplitude. The first amplitude is smaller than the second amplitude.

The vibrating member 14 includes a bracket 140 and a number of springs 142. The bracket 140 includes a main body 1400 with rectangular configuration, a protruding portion 1402 extending upwards from an upper face of the main body 1400, and a supporting portion including a number of columns 1404 extending downwards from a lower face of the main body 1400. The protruding portion 1402 is elastically engaged with the bottom surface 136 of the piezoelectric oscillator 13 as a result of the springs 142 nested on the columns 1404. Each column 1404 defines a smaller diameter than that of the through hole 125 of the lower cover 12 so as to moving in the through hole 125. The spring 142 defines a larger diameter than that of the through holes 125 so that the springs 142 could be limited between the main body 1400 and the bottom wall 124 of the lower cover 12. In other embodiment, both the number and the shape of the columns 1404 are not limited.

The diaphragm 15 is adhered to the upper surface 135 of the piezoelectric oscillator 13 and disposed between the piezoelectric oscillator 13 and the upper cover 10. The diaphragm 15 defines a same size as that of an underside of the first cavity of the upper cover 10.

A distance from the top face of the protruding portion 1402 to the bottom surface 136 of the piezoelectric oscillator 13 is larger than the first amplitude and smaller than the second amplitude, so that the vibration with the first amplitude of the piezoelectric oscillator 13 could only drive the diaphragm 15 to generate sound while the vibration with the second amplitude thereof could drive both the diaphragm and the vibrating member 14 to vibrate. In other embodiment, the vibrating member 14 could be adhered to the bottom surface 136 of the piezoelectric oscillator 13 so that vibration with any amplitude of the piezoelectric oscillator 13 could drive both the diaphragm 15 and the vibrating member 14 to vibrate.

The combination of the piezoelectric oscillator 13, the vibrating member 14, and the diaphragm 15 serves as a vibrating speaker unit of the piezoelectric speaker 1. The upper cover 10 and the lower cover 12 are together forming a receiving space for accommodating the vibrating speaker unit. The receiving space is divided into two cavities by the diaphragm 15 corporately with the piezoelectric oscillator 13. The first conductive slot 104 and the second conductive slot 126 are used for an outside wire electrically connected to the positive pole plates 132 and the negative pole plates 130.

The piezoelectric speaker 1 defines a controller outside providing electrically electric signals via the positive pole plate 132 and the negative pole plate 134 to the piezoelectric oscillator 13 so as to applying a electric field on the piezoelectric plates, which leads to converse piezoelectric effect of the piezoelectric plates and vibration of the piezoelectric oscillator 13. When the high-frequency electrical signal is supplied, the vibration with the first amplitude of the piezoelectric oscillator 13 drives the diaphragm 15 to generate voice. When the low-frequency electric signal is supplied, the vibration with the second amplitude of the piezoelectric oscillator 13 drives the protruding portion 1402 of the vibrating member 14 to vibrate so as to the columns 1404 moving up and down in the through holes 125. Therefore, functions of vibration and voice generating could be selected by adjusting the frequency of the electric signals. In the present embodiment, both the low frequency and the high frequency may be a specified value or a variable value within a specified frequency range.

The piezoelectric speaker 1 integrates functions of acoustic generator and vibration motor by using the inverse piezoelectric effect of the piezoelectric plate, which reduces the number of electronic components and brings a bigger inner space. Therefore, the piezoelectric speaker 1 has a simplified structure and low cost.

While the present disclosure has been described with reference to the specific embodiment, the description of the disclosure is illustrative and is not to be construed as limiting the disclosure. Various of modifications to the present disclosure can be made to the exemplary embodiment by those skilled in the art without departing from the true spirit and scope of the disclosure as defined by the appended claims.

What is claimed is:

1. A piezoelectric speaker, comprising:

a cover with a receiving space;

a vibrating speaker unit accommodated in the receiving space, including a piezoelectric oscillator including an upper surface and an lower surface, a diaphragm disposed on the upper surface of the piezoelectric oscillator, and a vibrating member kept a distance from the lower surface of the piezoelectric oscillator; wherein the piezoelectric oscillator defines a first amplitude capable of driving the diaphragm only and a second amplitude driving both the vibrating member to vibrating with a largest amplitude and the diaphragm to generate sound, the distance is larger than the first amplitude and smaller than the second amplitude.

2. The piezoelectric speaker as described in claim 1, wherein the cover defines an upper cover and a lower cover, the upper cover defines an upper wall with a number of sound holes and a pair of first conductive holes.

3. The piezoelectric speaker as described in claim 2, wherein the lower cover defines a lower wall with a number of through holes and a pair of second conductive holes.

4. The piezoelectric speaker as described in claim 3, wherein the vibrating member includes a bracket with a main body, a protruding portion extending upwards from an upper face of the main body, and a supporting portion including a number of columns extending downwards from a lower face of the main body and passing through the through holes of the lower wall.

5. The piezoelectric speaker as described in claim 4, wherein the vibrating member defines a plurality of springs nested around the columns and disposed between a lower face of the main body of the bracket and an upper face of the lower wall.

6. The piezoelectric speaker as described in claim 5, wherein the diaphragm is disposed between the upper cover and the piezoelectric oscillator.

7. The piezoelectric speaker as described in claim 6, wherein the diaphragm and the piezoelectric oscillator divide the receiving space into a first cavity and a second cavity.

8. The piezoelectric speaker as described in claim 7, wherein the piezoelectric oscillator defines a number of overlapping piezoelectric plates made from piezoelectric material, a pair of positive pole plates dispose at two surfaces of one end of the piezoelectric oscillator, and a pair of negative pole plates disposed at two surfaces of the other end of the piezoelectric oscillator.

9. The piezoelectric speaker as described in claim 8, wherein the piezoelectric speaker defines a controller outside providing electrical signals via a number of electrical wires passing through the first and second conductive holes to connect with the positive pole plates and the negative pole plates.

10. A piezoelectric speaker, comprising:

a cover with a receiving space;

a vibrating speaker unit accommodated in the receiving space, including a piezoelectric oscillator including an upper surface and an lower surface, a diaphragm attached to the upper surface of the piezoelectric oscillator, and a vibrating member attached the lower surface of the piezoelectric oscillator; wherein vibration of the piezoelectric oscillator with any amplitude is capable of driving the diaphragm to generate sound and the vibrating member to vibrate; wherein the vibrating member includes a bracket with a main body, a protruding portion extending upwards from an upper face of the main body, and a supporting portion including a number of columns extending downwards from a lower face of the main body.

11. The piezoelectric speaker as described in claim 10, wherein the cover defines an upper cover and a lower cover, the upper cover defines an upper wall with a number of sound holes and a pair of first conductive holes, the lower cover defines a lower wall with a number of through holes and a pair of second conductive holes.

12. The piezoelectric speaker as described in claim 11, wherein the number of columns extending downwards from the lower face of the main body and passing through the through holes of the lower wall.

13. The piezoelectric speaker as described in claim 12, wherein the vibrating member defines a plurality of springs nested around the columns and disposed between a lower face of the main body of the bracket and an upper face of the lower wall.

14. The piezoelectric speaker as described in claim 13, wherein the diaphragm is disposed between the upper cover and the piezoelectric oscillator, the diaphragm and the piezoelectric oscillator divide the receiving space into a first cavity and a second cavity.

15. The piezoelectric speaker as described in claim 14, wherein the piezoelectric oscillator defines a number of overlapping piezoelectric plates made from piezoelectric material, a pair of positive pole plates dispose at two surfaces of one end of the piezoelectric oscillator, and a pair of negative pole plates disposed at two surfaces of the other end of the piezoelectric oscillator.

16. The piezoelectric speaker as described in claim 15, wherein the piezoelectric speaker defines a controller outside providing electrical signals via a number of electrical wires passing through the first and second conductive holes to connect with the positive pole plates and the negative pole plates.

17. A piezoelectric speaker, comprising:

an upper cover with a number of sound holes;

a lower cover with a number of through holes;

a piezoelectric oscillator disposed between the upper cover and the lower cover;

a diaphragm disposed on an upper surface of the piezoelectric oscillator;

a vibrating member disposed under the piezoelectric oscillator; wherein the vibrating member defines a main body, a protruding portion extending upwards from the main body, a supporting portion extending downwards from the main body and passing through the through holes of the lower cover, and a spring assemble to the supporting portion for the vibrating member capable of moving up and down.

18. The piezoelectric speaker as described in claim 17, wherein the spring is limited between the main body and the lower cover.

19. The piezoelectric speaker as described in claim 18, wherein the protruding portion is capable of elastically engaged with a bottom surface of the piezoelectric oscillator.

20. The piezoelectric speaker as described in claim 18, wherein the protruding portion is attached to a bottom surface of the piezoelectric oscillator.

* * * * *